United States Patent [19]

Kelley

[11] Patent Number: 4,589,434

[45] Date of Patent: May 20, 1986

[54] METHOD AND APPARATUS TO PREVENT HYDRATE FORMATION IN FULL WELLSTREAM PIPELINES

[75] Inventor: Bruce T. Kelley, Houston, Tex.

[73] Assignee: Exxon Production Research Co., Houston, Tex.

[21] Appl. No.: 743,173

[22] Filed: Jun. 10, 1985

[51] Int. Cl.[4] ..... F17D 1/14

[52] U.S. Cl. ..... 137/1; 137/236.1; 137/206

[58] Field of Search ..... 166/370, 369, 362, 302; 137/1, 236, 206; 252/8.3

[56] References Cited

U.S. PATENT DOCUMENTS 3,780,750 12/1973 Perkins ..... 137/1 X 4,155,372 5/1979 Mills ..... 137/1

*Primary Examiner*—Alan Cohan

[57] ABSTRACT

The apparatus and method disclosed prevents hydrate formation in subsea oil and gas pipelines including at least one marine riser. The invention reduces the pressure on the fluids in a shut in pipeline by displacing fluids in the system into a reservoir thereby reducing the height of the column of fluids in the riser. A pump may be used to remove additional fluid from the fluid reservoir and pipeline to ensure the hydrostatic pressure associated with the final fluid level is below the pressure where hydrates may form at shut in temperatures. During start-up, a pump removes fluids from the fluid reservoir at about the same rate as produced fluids are allowed into the pipeline. The pump is shut down and pipeline operations are resumed when the liquid full wellstream fluids in the pipeline warm to a temperature outside the range where hydrates may form.

43 Claims, 2 Drawing Figures

METHOD AND APPARATUS TO PREVENT HYDRATE FORMATION IN FULL WELLSTREAM PIPELINES

BACKGROUND OF THE INVENTION

1. Field of the Invention

The present invention relates to a method and apparatus for preventing hydrate formation in pipelines which carry mixtures of hydrocarbons and water.

2. Description of the Prior Art

At low temperatures and high pressures, hydrates may form in full wellstream fluids containing water. Full wellstream fluids, also referred to as produced fluids, are unprocessed fluids from an oil and gas reservoir. Full wellstream or produced fluids typically include light gases, such as methane, ethane, propane, butane, carbon dioxide, hydrogen sulfide and water. The water present in full wellstream fluids can combine with the light gases, under certain conditions, to form hydrates.

Hydrates are crystalline solids. If the produced fluids from a particular reservoir include water, the light gases and the water in the produced fluids may combine to form hydrates. If hydrates form in a pipeline carrying produced fluids from an oil and gas well they can cause serious problems. Hydrates, for example, can completely plug piping, valves or other production equipment, thereby resulting in costly production delays.

High pressure in the presence of low temperature are the conditions which may cause the light gases and water in full wellstream fluids to combine and form hydrates. For example, at a temperature of 4.5° Centigrade (40° Fahrenheit) and a pressure of 105,500 Kg per square meter (150 psia) hydrates could form in a pipeline system containing full wellstream fluids.

These conditions are most commonly encountered in offshore operations where it is necessary to transport produced fluids in a long vertical pipeline, such as a riser system. The technology for drilling and completing oil and gas wells offshore has progressed to permit production from locations in deeper and deeper water. Typically, a riser system is used to vertically transport produced fluids to or from the ocean floor. A riser system is essentially a specially designed vertical pipe capable of withstanding the forces inherent to the offshore environment.

The weight of the fluid in the riser causes hydrostatic pressure. When the riser system is full of produced fluids, generally a column of liquid is formed with a height equal to the vertical length of the riser. Hydrostatic pressure is associated with any column of liquid. The weight of the liquid above a given point in the column of liquid increases the force per unit area at the given point. Consequently, as the height of the column of liquid in the riser increases, the hydrostatic pressure at the lowermost point in the pipeline also increases. The pressure in the lowermost portion of the pipeline can become quite high as the result of a long riser full of hydrocarbon liquid. Generally if the riser is 107 meters (350 feet to 400 feet) or longer, the hydrostatic pressure resulting from the column of produced fluids will be high enough so hydrates could form if the fluid temperature lowers into the hydrate formation range.

The temperature of the produced fluids is most likely to lower into the hydrate formation range if the flow of produced fluids is stopped for a prolonged period. When the flow stops for a prolonged period the produced fluids eventually cool to the temperature of the surroundings. The water temperature in the ocean decreases as depth beneath the ocean surface increases. The temperature at the floor of the ocean depends on surface conditions, currents and the depth below the surface. However, at depths below 107 meters (350 feet) the temperature at the ocean floor typically ranges from 2° Centigrade (35° Fahrenheit) to 7° Centigrade (45° Fahrenheit). The temperatures at these depths in combination with the hydrostatic pressure produced in a riser of that length provide the conditions conducive to hydrate formation.

In offshore operations there are numerous pipeline system configurations which include a long vertical riser. The particular pipeline system configuration chosen is usually dictated by economics. For example, as opposed to building a platform for each well, the produced fluids from several subsea wells may be transported up to a satellite platform. To keep the facilities on the satellite platform at a minimum, the produced fluids may then be transferred by pipeline to a central platform for processing. The transfer pipeline would run along the ocean floor and include two risers, one to transport the produced fluids to the ocean floor and another to transport the fluids from the ocean floor to the central platform. Other pipeline system configurations having a riser include transporting produced fluids from one subsea well to a platform for processing, and transporting produced fluids from an underwater manifold center, serving as a collection point for several subsea wells, to a platform for processing.

There generally are less problems with the formation of hydrates under normal operating conditions than during shutdown conditions since the full wellstream fluids usually do not reach the relatively low temperatures at which hydrates form. The temperature of fluids produced from a reservoir usually ranges from 43° Centigrade (110° Fahrenheit) to 149° Centigrade (300° Fahrenheit). Heat is lost from the full wellstream fluids as they pass up the wellbore and through the pipeline system. However, as long as the full wellstream fluids flow continuously, they generally do not enter the hydrate formation range. If the heat loss would cause the temperature of the fluids to drop into the hydrate formation range, the pipeline can be insulated to lessen the heat loss and prevent hydrate formation.

In the past, several methods have been used to prevent hydrate formation in subsea pipeline systems which transport produced fluids which include water. One method involves injecting a chemical hydrate inhibitor, such as methanol or glycol, into the pipeline. These chemicals dissolve in the free water in the produced fluids and lower the temperature at which hydrates will form. The concentration of inhibitor in the water determines the depression of the hydrate formation temperature. This method has several drawbacks. Because operators never know when an emergency shutdown will occur, all the produced fluids passing through the pipeline must be treated. This is the only way, using this particular method, to assure that the produced fluid in the pipeline system after an emergency shutdown will not form hydrates. Extremely large quantities of methanol or glycol are needed to continuously treat a full wellstream fluid containing significant quantities of water. Injecting chemical hydrate inhibitors into the pipeline will therefore usually be economically impractical because of the large quantity of chemicals required and the costs of transporting the chemicals to an offshore location.

In some cases, hydrate inhibiting chemicals can be economically recovered after their use, such as when treating a water saturated gas stream. However, when treating produced liquids that include water, the recovery of chemical hydrate inhibitors is usually economically impractical since, in most cases, the hydrate inhibitors can not be recovered economically. The salt present in water from the reservoir contaminates the chemicals and makes the recovery of the chemicals very difficult.

Another method of hydrate prevention consists of displacing the hydrocarbons in the pipeline with fluids that will not form hydrates, such as stabilized crude. Because of the extreme volume of a pipeline system, large quantities of fluids that will not form hydrates are needed which makes this method costly and unattractive. Further, this method is not completely reliable since pumping facilities are required at the ocean surface on one end of the pipeline. During an emergency shutdown power may not be available for the needed pumping facilities.

Another method that may be used is partial processing of the full wellstream fluids from the reservoir before transporting the fluids in a pipeline. Hydrates only form in the presence of water. Therefore, hydrate formation can be prevented by removing water from the produced fluids. Another partial processing method removes light hydrocarbons, which combine with water to form hydrates, from the produced fluids.

Several drawbacks are also associated with partially processing the produced fluids. Costly equipment is needed to partially process the produced fluids. In addition, the equipment requires space, which is at a premium in offshore operations. After partial processing, the removed substances must be stored, disposed of, or transported to another location. If water is removed from the produced fluids it must be treated before disposal. The light gases are of particular concern. The gases must either be transported in a separate pipeline to a processing platform or flared. The gas pipeline is an additional cost and also requires hydrate inhibition if the gas is not dehydrated by partially processing it on the satellite platform. Gases can be flared, however, in some areas flaring is disallowed.

Because of the equipment needed, use of the partial processing methods require a satellite platform. Therefore, partial processing before transportation is not possible when a platform is not used, such as when subsea satellite wells are produced individually or several subsea wells are produced from an underwater manifold center.

Thus, there is a need for an apparatus and method for preventing hydrate formation adaptable to any transfer pipeline, such as from a satellite platform, an underwater manifold center or a subsea well. Furthermore, there is a need for a less costly method which does not require the chemicals or equipment needed to either inject hydrate inhibitors, displace the hydrocarbon fluid or partially process the full wellstream fluids. Furthermore, there is a need for a reliable apparatus and method that will not require a source of power which may be unavailable in an emergency shutdown.

SUMMARY OF THE INVENTION

The invention prevents hydrate formation by lowering the pressure on the production fluids in the pipeline system. The pressure is reduced by reducing the height of the column of liquid production fluids in the riser system. A fluid reservoir is provided to receive fluids from the pipeline system. A liquid level controller regulates the level of produced liquids in the fluid reservoir. Under normal operating conditions, the fluid reservoir is filled with gas and is substantially empty of liquids. When the flow of liquid in the pipeline is shut down, an amount of liquid is trapped in the pipeline system. The liquid level controller allows some of the produced liquids in the pipeline system to enter the fluid reservoir. The liquid level in the riser system therefore falls, resulting in reduced hydrostatic pressure in the pipeline system. The volume of the fluid reservoir is selected so the hydrostatic pressure associated with the final liquid level in the riser system is low enough to be outside the range of pressures where hydrates may form.

When the pipeline system is shut down for a prolonged period, the produced fluids remaining in the pipeline cool to the temperature of the surrounding environment. To restart flow in the pipeline system, production from the well is resumed and a submersible pump is used to remove produced liquids from the fluid reservoir at about the same rate as the produced fluids from the well enter the pipeline system. Thus, the pump keeps the liquid level in the riser system below a height where hydrostatic pressure would cause hydrates to form. In addition, the pump circulates the relatively warm produced fluids through the pipeline system from the well to the fluid reservoir. When the full wellstream fluids warm the pipeline system to an operating temperature outside the hydrate formation range, the pump may be shut off and the pipeline pressure allowed to rise to normal operating levels. Normal operation of the pipeline is thereby resumed.

DESCRIPTION OF THE PREFERRED EMBODIMENT

Introduction

The invention is a method and apparatus for inhibiting hydrate formation. The following description of the preferred embodiment focuses on the apparatus of the invention. The method of the invention is apparent from the foregoing Summary and the description that follows.

Figure 1:
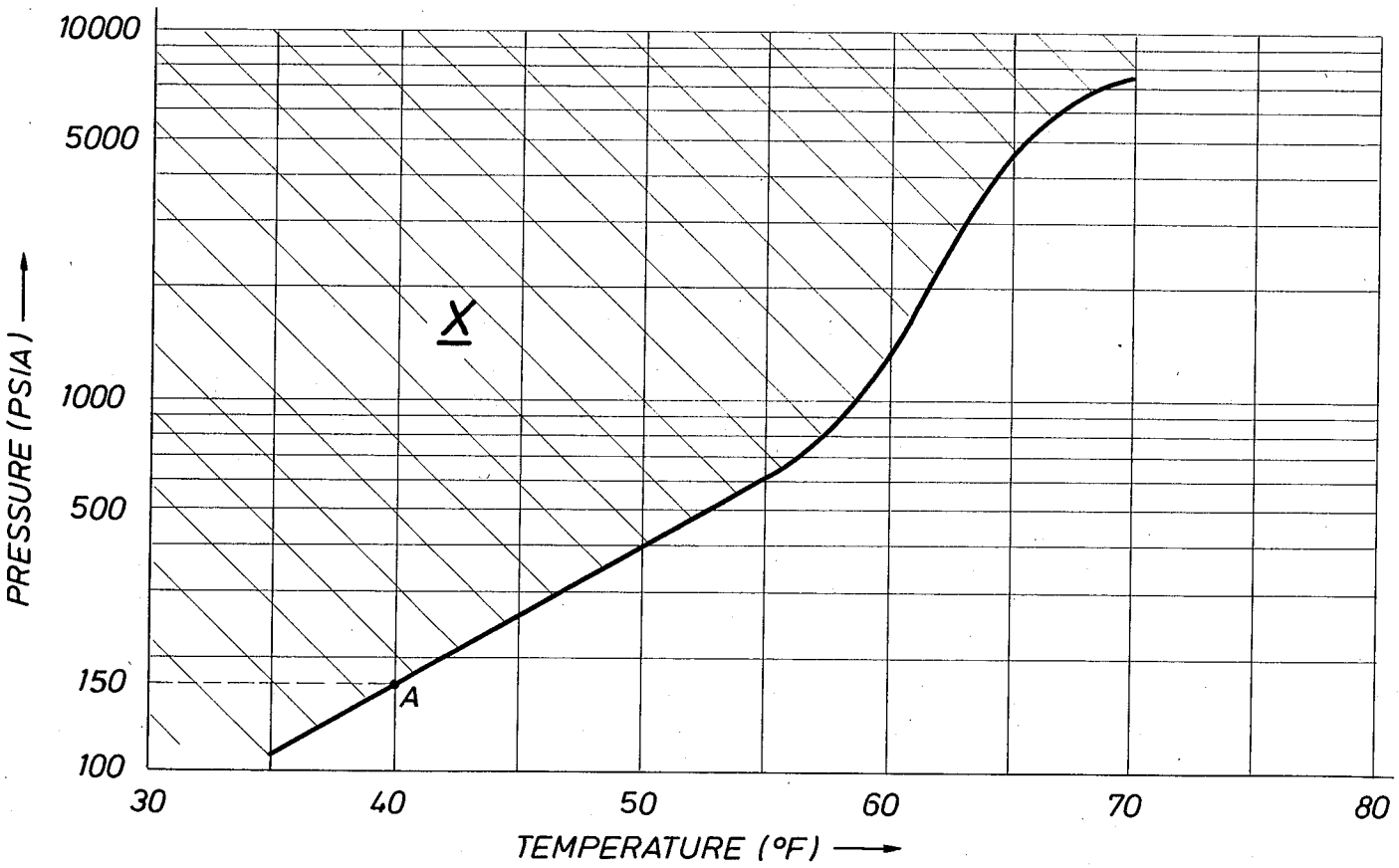
FIG. 1 is a graph illustrating a typical relationship of pressure and temperature to the formation of hydrates.

It should be understood that fluids include both liquids and gases. When either liquids or gases are referred to in this application, the liquid state or gaseous state of the fluid, respectively, is being referred to. FIG. 1 shows a typical example of the relationship of temperature and pressure on the formation of hydrates for fluids produced from a particular reservoir. The cross-hatched region shown in FIG. 1 shows the range of temperature and pressure combinations where hydrates are likely to form. It should be noted that produced fluids vary between reservoirs and each fluid has a hydrate formation curve specific to that fluid.

As was discussed previously, a typical seabed temperature is 4.5° Centigrade (40° Fahrenheit). The hydrostatic pressure associated with a riser filled with liquid full wellstream fluids approximately 122 meters (400 feet) long can be equal to or greater than 105,500 Kg per square meter (150 psia) in the lower-most portion of the pipeline system. As shown by the cross-hatched region X of FIG. 1, at pressures in excess of 105,500 Kg per square meter (150 psia) and a temperature of 4.5° Centigrade (40° Fahrenheit) hydrates may form. Point A in FIG. 1 shows that with the above temperature and pressure combination of 4.5° Centigrade (40° Fahrenheit) and 105,500 Kg per square meter (150 psia) hydrates may form.

Detailed Description

Figure 2:
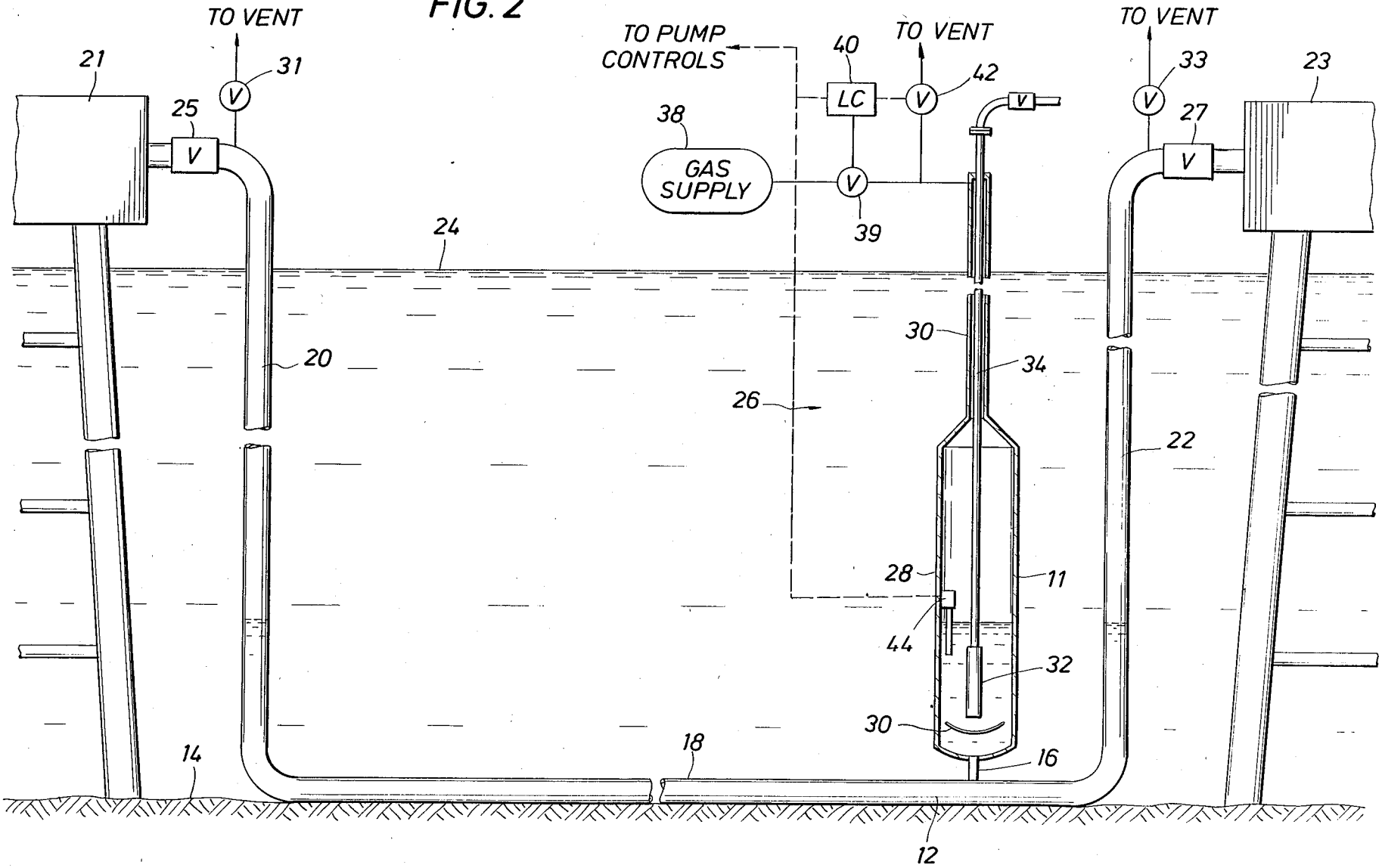
FIG. 2 is a side elevation view of one embodiment of the hydrate prevention apparatus in communication with a pipeline system.

The apparatus used to prevent hydrate formation is indicated generally in FIG. 2 by reference number 26. The apparatus 26 will generally be used in offshore applications where the water depth is 91 meters (300 feet) or more. As a matter of economics, full wellstream fluid is generally processed at a central platform 23 since there may be several reservoirs in a subsea oil and gas field. When a portion of the production is remote from the central platform 23, the full wellstream fluid is lifted from a subsea well to a satellite platform 21 by methods well known in the art, such as pumping. The full wellstream fluid is then transferred through a pipeline system 18 from the satellite platform 21 to the central platform 23 for processing and storage. Since there may be several reservoirs in a subsea oil and gas field, several satellite platforms may be located around the central platform and provide produced fluids to the central platform 23.

A pipeline system 18 is used to transfer the full wellstream fluid from the satellite platform 21 to the central platform 23. The pipeline system 18 includes a first riser section 20, a second riser section 22, and a seafloor transfer pipeline 12. The pipeline system 18 also includes a valve 25 for shutting off the flow at the satellite platform 21, a valve 27 for shutting off the flow at the central platform 23, a valve 31 for venting the first riser section 20 to atmosphere and a valve 33 for venting the second riser section 22 to atmosphere.

To reduce the pressure in the lower portion of the pipeline system 18 when it is shut down, a fluid level control reservoir 11 is provided in fluid communication with the lower portion of the pipeline system 18. The fluid reservoir 11 is connected to the pipeline system 18 with a pipe 16. A pressurized gas is maintained inside the fluid reservoir 11. By regulating the pressure of the gas the level of fluid in the fluid reservoir 11 can be controlled. When the pressure on the gas is less than the pressure on the full wellstream fluids in the pipeline system 18, liquids fill the fluid reservoir 11. Similarly, when the pressure on the gas is greater than the pressure on the full wellstream fluids in the pipeline system 18, the liquid level in the fluid reservoir 11 drops. The liquid level in the fluid reservoir 11 will be maintained at a constant level when the gas pressure equals the pressure on the full wellstream fluids in the pipeline system 18.

When the pipeline system 18 is transporting full wellstream fluids, the fluid reservoir 11 is full of pressurized gas and contains no liquids. When the pipeline system 18 is shut down, a fixed amount of fluid remains in the first riser section 20, the second riser section 22 and the seafloor transfer pipeline 12. After shutdown, the pressure on the gas in the fluid reservoir 11 is reduced to allow full wellstream fluids from the pipeline system 18 to enter the fluid reservoir 11. This, in turn, reduces the height of the liquid in the first riser section 20 and the second riser section 22. Eventually the liquid levels in the first riser section 20, second riser section 22 and the fluid reservoir 11 will settle to approximately the same level. The fluid reservoir 11 is designed to accommodate a sufficient volume of the full wellstream fluids from the pipeline system 18, such that when the liquid levels in the fluid reservoir 11 and the risers reach the equilibrium level, the pressure in the pipeline system 18 and the fluid reservoir 11 will be outside the range in which hydrates will form at the shut-in temperature of the fluid in the fluid reservoir and pipeline.

Preferably, the fluid reservoir 11 is attached to the seafloor transfer pipeline 12. However, the fluid reservoir can also be attached to the first riser section 20 or the second riser section 22. For reasons pointed out below, the fluid reservoir 11 will preferably be located near the central platform 23.

It should be understood that the fluid reservoir 11 is not limited to a single container, as shown. For example, it would be possible to place one fluid reservoir near the central platform 23 and a fluid reservoir near the satellite platform 21. The shape of the fluid reservoir 11 is also not limited to that of a pipe or cylinder. One possible configuration for the fluid reservoir 11 would be to incorporate it into the structure of a platform.

Preferably, the fluid reservoir 11 is sealed except for the opening to the pipe 16 and the opening to the vent valve 42 and gas supply valve 39. The fluid reservoir 11 preferably includes a wide lower portion 28 so that produced fluids in the reservoir have an adequate surface area to facilitate degassing of the fluids while in the fluid reservoir 11. A submersible pump 32 is positioned inside and near the bottom of the fluid reservoir 11 in the wide lower portion 28 of the fluid reservoir 11 so that its intake is submerged in the liquids in the fluid reservoir 11 after the equilibrium level has been reached. If the fluid reservoir 11 is comprised of more than one container, only one pump 32 is needed. It may be positioned inside any one of the containers. Preferably, the pump 32 will be located in the fluid reservoir 11 as close to the central platform 23 as is practical to allow the pump 32 to circulate fluids through the maximum practical length of the pipeline system 18 during start-up. The submersible pump 32 can be electric, water driven, gas driven or powered by any other suitable means. Positioned in the fluid reservoir 11 below the submersible pump 32 is a baffle 30 which directs any gas slugs entering the fluid reservoir 11 around the pump 32. Without the baffle 30, a gas slug entering the chamber 10 could rise into the region near the pump 32 causing the pump 32 to cavitate, possibly resulting in severe damage to the pump 32.

Attached to the pump 32 and extending up through the fluid reservoir 11 is a flowline conduit 34. The lower end of flowline conduit 34 is attached to the output of the pump 32. The point where the flowline conduit leaves the fluid reservoir can be above or below the ocean surface 24. The pump 32 can be attached directly to the flowline conduit 34 or it may be seated in the end of the flowline 34 and suspended from a cable (not shown) as is well known in the art of submersible downhole pumps. The upper end of the flowline conduit 34 may be attached to a storage tank (not shown) on the central platform 23 or tied in directly to the processing facilities (not shown) on the central platform 23.

It is preferable to have the wide lower portion 28 of the fluid reservoir 11 extend to a level several feet above the inlet of the pump 32. The liquid full wellstream fluids will preferably be at a level several feet above the pump 32 so the liquid near the pump 32 is pressurized and will enter the pump 32.

In addition, if the liquids in the fluid reservoir have a large surface area degassing of the liquid full wellstream fluid is facilitated. Preferably, the liquid full wellstream fluids in the fluid reservoir 11 will be degassed so they can be pumped to the central platform 23 or to a storage tank near the ocean surface 24 without hydrate formation in the flowline conduit 34. If the liquid in the fluid reservoir 11 is not degassed, the column of liquid full wellstream fluids in the flowline conduit 34 could produce a pressure that at seabed temperatures could result in hydrate formation.

Liquid full wellstream fluids are admitted into the fluid reservoir 11 by permitting the fluid reservoir to vent to atmospheric pressure through the vent valve 42. This venting of the fluid reservoir 11 also serves another important purpose. Venting the fluid reservoir 11 to atmosphere facilitates degassing of the full wellstream fluids by exposing them to a pressure less than the operating pressure in the pipeline system 18. As a result of this pressure differential, the lighter gases in the liquid full wellstream fluid more fully evolve from the full wellstream fluids in the fluid reservoir 11. The possibility of hydrates forming in the flowline conduit 34 will therefore be reduced since the components necessary to form hydrates, namely, the light gases, are partially or totally removed from the liquid full wellstream fluids.

As the fluid levels drop in the first riser section 20 and the second riser section 22, in most cases a sufficient amount of gas will evolve from the liquid full wellstream fluids in the risers so that the pressure at the top of each riser section will remain greater than atmospheric pressure. If the pressure were to fall below atmospheric pressure, air could enter the riser. If air enters the risers, the possibility of corrosion increases greatly. Furthermore, if air enters the risers, 20 and 22, a safety hazard results since light hydrocarbons in the presence of oxygen may result in explosive combustion. In the event it is determined that gases would not evolve from the liquids in an amount sufficient to maintain the pressure above atmospheric, a gas supply could be provided to each riser. One source of suitable gas is the gas vented from the fluid reservoir 11 as the fluid reservoir fills.

A level controller 40 controls a gas supply valve 39 and a vent valve 42 to control the pressure of the gas in the fluid reservoir 11. A pressurized gas supply 38 communicates with the interior of the fluid reservoir 11 through the gas supply valve 39. Gas can be added to the fluid reservoir 11 from the gas supply 38 by opening the gas supply valve 39. The source of the gas in the gas supply 38 may be the product of processed full wellstream fluids from the central platform 23. Gas can be removed from the fluid reservoir 11 by venting the gas to the atmosphere through the vent valve 42.

Attached to the fluid reservoir 11 is a level sensing and transmitting device 44 which is well known in the art. Several types of level sensing and transmitting devices can be used in the invention such as a sonic level detector used in the invention. The preferred type would be one which does not require subsea components such as a sonic detector mounted at the top of the riser 30. Alternatively, a level sensor having a relatively long expected life, such as one utilizing a nuclear source, could be installed subsea. The level sensing and transmitting device 44 senses the level of liquid full wellstream fluids in the fluid reservoir 11. This information is relayed to the level controller 40. The level controller 40 controls the gas supply valve 39 and the vent valve 42 which control the gas supply 38 and the vent, respectively to vary the level in the fluid reservoir 11.

A chemical hydrate inhibitor, described below, may be added to the fluids in the fluid reservoir 11 as a precaution against hydrate formation in flowline conduit 34. The full wellstream fluids in the fluid reservoir 11 are generally degassed during startup and shut down of the pipeline system 18 since the fluid reservoir 11 will preferably be vented to atmosphere. At atmospheric pressures light gases evolve from the liquids in the fluid reservoir 11. Consequently, hydrates will not form in the flowline conduit 34. Therefore, addition of a hydrate inhibitor will provide redundant protection against hydrate formation in flowline conduit 34.

A delivery line (not shown) for the above chemical hydrate inhibitor could be attached to the flowline conduit 34 along the length of the flowline conduit 34 to carry a hydrate inhibitor, such as glycol or methanol, from a storage tank at or near the ocean surface to a point near the pump 32. The inhibitor can be injected into the fluid reservoir 11 when needed. This insures that hydrates will not form in the flowline conduit 34. The line could also be used to inject corrosion inhibitor into the fluid reservoir 11.

Preferably the gas placed in the fluid reservoir 11 from gas supply 38 is dehydrated. Dehydrated gas has several advantages. Dehydrated gas minimizes corrosion inside the fluid reservoir 11. In addition, if the supply of gas is not dehydrated, hydrates may form when the gas is admitted into fluid reservoir 11 and allowed to cool.

Pipeline Operation

The apparatus 26 to prevent the formation of hydrates is employed differently depending upon whether operations in the pipeline 18 are continuing normally, are being shut down, or are being resumed after a prolonged shutdown.

Normal Operations

During normal pipeline operations the full wellstream fluids are simply being transported through the pipeline system 18 from the satellite platform 21 to the central platform 23.

The fluid reservoir is kept empty during normal operations for several reasons. It is important to keep the fluid reservoir 11 empty so the volume of the fluid reservoir 11 is available to receive fluids from the pipeline system 18 in the event of a shutdown.

In addition, the fluid reservoir 11 is kept empty to prevent the full wellstream fluids in the fluid reservoir 11 from cooling into the region where hydrates may form. If the fluid reservoir 11 is not kept empty during normal operations, the full wellstream fluids in the fluid reservoir 11 may stagnate or not mix with the warm full wellstream fluids passing through the pipeline system 18. The full wellstream fluids in the fluid reservoir 11 would eventually cool to the temperature of the surrounding environment. The pressure at the bottom of the fluid reservoir 11 will be equal to the pressure in the pipeline system 18 near the fluid reservoir 11. The pressure and temperature of the full wellstream fluids in the fluid reservoir 11 could therefore be within the hydrate formation range. Thus, to prevent hydrate formation and keep the volume of the fluid reservoir 11 available to receive full wellstream fluids from the pipeline system 18, the fluid reservoir 11 is kept empty of liquids during normal operations.

To keep the fluid reservoir 11 empty of full wellstream fluids, the gas in the fluid reservoir 11 is maintained at a sufficiently high pressure so that no liquid enters the fluid reservoir 11 and no gas enters pipeline system 18. Preferably, the full wellstream fluids are maintained at a constant level in the pipe 16 between pipeline system 18 and the fluid reservoir 11. The liquids in the pipe 16 should not cool into the hydrate formation because they will be heated by the fluids flowing in the pipeline system 18. If desired to further ensure against hydrate formation, the pipe 16 can be insulated to minimize heat loss from the liquid located therein. Other options are available for minimizing heat loss in pipe 16, such as electrically heating the pipe 16, or circulating a warmer fluid in a tubing coiled around pipe 16.

In the event liquid full wellstream fluids enter the fluid reservoir 11, the level sensing device 44 indicates this and signals the level controller 40. The level controller 40 then signals the gas supply valve 39 to admit gas from the gas supply 38 to increase the pressure of the gas in the fluid reservoir 11. The pressure is increased until the liquid in the fluid reservoir moves back into pipe 16. The level sensing device 44 senses when the liquids reach the proper level and signals the level controller 40 to stop the flow of gas into the fluid reservoir 11 from gas supply 38.

Shutdown

When the pipeline 18 is shut down the valve 25 at the satellite platform 21 and the valve 27 at the central platform 23 are closed. As a result, a fixed amount of full wellstream fluids are trapped in the pipeline system 18 when it is shut down. This forms a column of liquid full wellstream fluids in both the first riser section 20 and the second riser section 22. If the length of the first riser section 20 or the second riser section 22 is greater than approximately 91 to 122 meters (300 to 400 feet), it is likely that the hydrostatic pressure produced by the columns of liquid full wellstream fluids will place the fluids in the hydrate formation range if the fluids cool to the temperature at the seabed 14. Thus, if it is anticipated that the pipeline system 18 will be shut down for a prolonged or indefinite period of time so the full wellstream fluids may cool into the hydrate formation range, measures must be taken to reduce the pressure in the pipeline system 18.

The pressure is reduced in the pipeline system 18 by reducing the fluid level in each riser. This is accomplished by transferring full wellstream fluids from the pipeline system 18 to the fluid reservoir 11 to lower the level of the fluid in the risers. To transfer the full wellstream fluids into the fluid reservoir 11 the fluid reservoir 11, is vented to the atmosphere by opening the vent valve 42. This allows the fluid reservoir 11 to fill as the liquid level in the risers falls. As the liquid level in the risers 20 and 22 falls, gas will evolve from the full wellstream fluids to occupy the volume above the liquids in the first riser section 20 and the second riser section 22. The first riser section 20 and the second riser section 22 are preferably vented to atmosphere using the vent 31 and the vent 33, so that the gases that evolve from the liquids in the riser will be removed from the riser. This will prevent back pressure on the liquids in the riser and allow the liquids to degas. Venting the first riser section 20 and the second riser section 22 to atmospheric pressure allows the light gases to more completely evolve from the full wellstream fluids therein. The rate at which gas is vented from the risers may need to be limited to avoid excessive Joule-Thompson cooling of the fluids, and the risk of hydrate formation, in the risers or pipeline. Opening the vent 31 and the vent 33 to atmosphere will insure that the only pressure in the pipeline system 18 is that of hydrostatic head.

As the fluid reservoir 11 fills, the fluid level in each riser drops. The full wellstream fluids enter the fluid reservoir 11 until the fluid level in the first riser section 20, the second riser section 22 and the fluid reservoir 11 reach approximately the same level.

The choice of the volume of the fluid reservoir 11 during the design stage determines whether or not the pump 32 is used during shutdown of the pipeline system 18. If the volume of the fluid reservoir 11 is large enough so the final equilibrium fluid level in the risers and fluid reservoir 11 results in a hydrostatic pressure outside the range where hydrates may form, the pump 32 is not needed during shutdown. If the volume of the fluid reservoir 11 is smaller, the equilibrium level of the fluid may be so high that the hydrostatic pressure in the pipeline system 18 will be in the hydrate formation range. The pump 32 will then be used to remove additional amounts of full wellstream fluids from the pipeline system 18 during shutdown. The pump 32 need only remove enough full wellstream fluid so the final equilibrium fluid level will not produce a pressure where hydrates may form at the temperature of the seabed 14.

Once enough of the full wellstream fluids are displaced from pipeline system 18 so the hydrostatic pressure associated with the equilibrium liquid level is below hydrate producing range, the full wellstream fluids can remain in the pipeline system 18 and the fluid reservoir 11 indefinitely without fear of hydrate formation.

Start-up

Start-up of the pipeline system 18 after a prolonged shutdown is described below. To resume normal operation of the pipeline system 18, it is necessary that the fluids in the pipeline system be in a condition in which hydrates will not form during start-up. Obviously, it is not practical to open the shutoff valves 25, 27 and pump the fluids in the pipeline system 18 up the second riser section 22 to the facilities on the central platform 23. This is because the relatively cool fluids in the pipeline system 18 would have to be subjected to pressures at least equal to and more likely in excess of the hydrostatic head of a full column of cool fluids in the riser 22. This pressure would place the cool fluids in the hydrate formation range. To avoid the above situation, it is necessary that the fluids in the pipeline system 18 be in a state such that hydrates will not form in the fluids under the conditions, including the pressure and temperature, encountered during start-up. Naturally, the conditions encountered during start-up will be different for each application of the invention and will depend on the temperature of the fluids in the pipeline system, the length of the risers, the length of the pipeline system and the pipeline pressures required to flow the fluids through the pipeline system.

Fluids that are in a state such that hydrates will not form in them during start-up include fluids that have been degassed or dehydrated or fluids that are relatively warm. There are several ways to ensure the fluids in the pipeline system 18 will be in a state such that they remain free from hydrates during start up. For example, the relatively cool fluids in the shutdown system could be warmed or treated with chemical hydrate inhibitor. However, there are practical problems with treating all the fluids in the pipeline system 18. Large quantities of hydrate inhibitor would be needed to treat all the fluids in the pipeline system 18 particularly if the seafloor transfer pipeline 12 of the pipeline system 18 is long. It is therefore preferable to replace the fluids in the pipeline system 18 with fluids in which hydrates will not form during start-up. Relatively warm produced fluids are such fluids. Start up utilizing such produced fluids is described below.

To start up the pipeline system 18, shut off valve 25 is opened to permit warm produced fluids to flow into the pipeline system 18. The pump 32 is started shortly after the valve 25 is opened and liquids are removed from the fluid reservoir 11 at the same rate as the warm produced fluids enter the system through the shut off valve 25. The liquid level in the first riser section 20, the second riser section 22 and the fluid reservoir 11 resulting from shutdown of the pipeline system 18 must be maintained at a level low enough to prevent hydrates from forming. Therefore, to maintain a low level, the rate at which the pump 32 removes liquid full wellstream fluids from the fluid reservoir 11 is adjusted to equal the rate at which warm full wellstream fluids from the pipeline system 18 enter the fluid reservoir 11. As a result, the liquid level in the first riser section 20, the second riser section 22 and the fluid reservoir 11 will be maintained at essentially the same level. However, in reality, the liquid level at riser section 20 will be slightly higher than the liquid level at riser section 22 due to the pressure drop in the pipeline system 18.

Typically the pump 32 selected during the design stages will, to reduce the cost of the pump, not have sufficient capacity to remove liquids at the maximum rate at which full wellstream fluids can be transferred through the pipeline system 18. Thus, if the maximum flow rate of full wellstream fluids is admitted into the pipeline system 18 during the initial stages of start-up, the pump 32 will be unable to maintain the liquid levels at a low enough level to prevent hydrate formation. The flow rate can be adjusted with shut off valve 25. However, to lessen the possibility of operator error, equipment may be placed on the satellite platform 21 to restrict the flow rate of the full wellstream fluids during start-up.

The pump 32 need only be used for a limited amount of time during start up. Circulating the warm produced fluids through the pipeline system 18 warms the pipeline system 18 to a temperature outside the range where hydrates may form. As soon as the cool fluids initially in the pipeline system 18 are removed and the temperature of the fluids in the pipeline system 18 rises beyond the hydrate formation range, the pump 32 can be shut off. The pipeline system 18, except for the second riser section 22, will then be filled with a fluid in which hydrates cannot form during start-up.

If some fluid other than warm produced fluids in which hydrate will not form is used during the start-up to displace the liquid in the pipeline system 18 pump 32 may be shut off when the fluids initially in the pipeline system 18 are displaced with the start-up fluids. As stated above, such fluids in which hydrates will not form may be full wellstream fluids which have been adequately inhibited or full wellstream fluids processed to remove either sufficient amounts of water or sufficient amounts of light gases so hydrates will not form.

As the pump 32 removes fluids from the fluid reservoir 11, fluids in which hydrates will not form during start-up are circulated in the pipeline system 18 between the satellite platform 21 and the fluid reservoir 11. Little or no fluids in which hydrates will not form during start-up may circulate between the point where pipe 16 attaches the pipeline system 18 and the central processing platform 23. Consequently, the fluids between the point where pipe 16 attaches to the pipeline system 18 and the central platform 23 may remain cool. As a result, during initial start-up the total pressure on the cool liquid that may be remaining in the pipeline system 18 must be kept below the pressure where hydrates may form.

The total pressure on the fluid that may be cool in the pipeline consists of two components—the pressure required to pump the fluid through the pipeline system 18 and the hydrostatic pressure on the cool fluid. Shortly after full flow is started, the cool fluids remaining in the pipeline system 18 are the first to be pushed through the second riser section 22 and form a column of cool fluids at the top of the column of fluids formed in the second riser section 22. The position of the pipe 16 determines the amount of hydrostatic pressure on the cool fluids. The smaller the quantity of cool fluids the shorter the column of cool fluids. The shorter the column of cool fluids formed and the lesser the hydrostatic pressure component of the total pressure on the cool fluids. The closer the pipe 16 is positioned to the second riser section 22, the smaller the quantity of cool fluids. Thus, pipe 16 should be attached to pipeline system 18 as close to the central platform 23 as is practicable to minimize the hydrostatic pressure component of the total pressure on the column of cool fluid initially pushed through the pipeline system 18. The pressure needed to move the produced fluid through the line can then be left constant if the total pressure on the cool fluids is less than the pressure where hydrates may form. If the total pressure is greater than the pressure where hydrates may form, the pressure needed to move the fluids through the pipeline system 18 must be reduced. If the hydrostatic component of the pressure is minimized the reduction in the pressure needed to move the fluid through the pipeline system 18 is also minimized.

The next step in start-up is return to the pipeline system 18 to normal operations. To resume normal operations the pump 32 is shut off. Then the pressure in the fluid reservoir 11 is increased to empty the fluid reservoir 11 of liquid full wellstream fluids. When the liquids are removed from the fluid reservoir 11, the level sensing device 44 and level controller 40 will control the gas supply valve 39 and the vent valve 42 to maintain the fluid level at a proper level as described above in the normal operations section. Full wellstream fluids from the satellite platform can then be allowed to fill the pipeline system 18 completely with warm fluids. This completes start-up without the formation of any hydrates. The pipeline is now operating normally.

It should be understood that the apparatus 26 and methods disclosed for preventing hydrates are not limited to pipelines having two risers and a length along the seabed floor. The apparatus 26 and methods disclosed can be used to prevent hydrates from forming in pipelines of various configurations. The configurations having hydrate formation problems generally have lengthy riser traveling from the seabed 14 to the ocean surface 24. A pipeline configuration having a riser ascending from a transfer pipeline originating at an underwater manifold center or at a subsea well are examples of configurations where hydrate formation may also be a problem. The apparatus 26 and methods disclosed can be used by persons of ordinary skill in the art in all configurations of a pipeline where hydrate formation arising from hydrostatic pressure in a riser is a problem.

Furthermore, it should also be understood that the apparatus 26 and methods disclosed for preventing hydrates are not limited to pipelines transporting full wellstream fluids. The apparatus and method disclosed can be used to prevent hydrate formation in any fluid, such as partially processed full wellstream fluids, being transferred through a pipeline. Therefore, "produced fluids" corresponds to other analogous fluids in which hydrates may form.

The invention may be embodied in other specific forms without departing from its spirit or essential characteristics. The described embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

I claim:

1. Apparatus to prevent hydrate formation in a shut down pipeline system for transporting produced fluids, the pipeline system having at least one riser initially containing a column of produced fluids when the pipeline system is shut down, said apparatus comprising:

a fluid reservoir in fluid communication with the pipeline system for receiving produced fluids from the pipeline system when the system is shut down; and a fluid level controller adapted to transfer produced fluids from the pipeline system to the fluid reservoir when the pipeline system is shut down in an amount sufficient to reduce the height of the column of produced fluids in the riser, and the hydrostatic pressure in the pipeline system resulting therefrom, an amount sufficient to prevent hydrate formation in the produced fluids in the shut down pipeline system at the temperature of such fluids.

2. The apparatus as defined in claim 1 wherein said fluid level controller comprises:

a pressurized gas supply communicating with the fluid reservoir;

a gas supply valve connected to the pressurized gas supply for controlling flow of the pressurized gas into the fluid reservoir;

a vent valve for reducing the pressure of the gas in the fluid reservoir communicating with the gas in the fluid reservoir;

a level sensing device on the fluid reservoir for sensing the level of the liquid in the fluid reservoir and generating a signal based on the level of liquid, wherein the fluid level controller operates the gas supply valve and the vent valve in response to the signal based on the level of the liquid to control the pressure of the gas inside the liquid reservoir, thereby transferring produced fluids between the fluid reservoir and the pipeline system.

3. Apparatus to prevent hydrate formation in a pipeline system for transporting produced fluids when the pipeline system is shut down and during start-up, the pipeline system including at least one riser initially containing a column of produced fluids when the pipeline system is shut down and a source of a second fluid in which hydrates will not form at the conditions encountered during start up of the pipeline system, comprising:

a fluid reservoir in fluid communication with the pipeline system for receiving produced fluids from the pipeline system when the system is shut down;

a fluid level controller adapted to transfer produced fluids from the pipeline system to the fluid level control reservoir when the pipeline system is shut down in an amount sufficient to reduce the height of the column of produced fluids in the riser, and the hydrostatic pressure in the pipeline system resulting therefrom, an amount sufficient to prevent hydrate formation in the produced fluids in the shut down pipeline system; and a pump in fluid communication with the pipeline system and the source of the second fluid for circulating the second fluid into the pipeline system prior to start up of the pipeline system to prevent hydrate formation therein when operation of the pipeline system is resumed.

4. The apparatus of claim 3 wherein the second fluid is warm produced fluids and the pump is adapted to pump the warm produced fluids through the pipeline system to warm the pipeline system to a temperature sufficient to prevent hydrate formation during start up of the pipeline system.

5. The apparatus as defined in claim 3 wherein said fluid level controller comprises:

a pressurized gas supply communicating with the fluid reservoir;

a gas supply valve connected to the pressurized gas supply for controlling flow of the pressurized gas into the fluid reservoir;

a vent valve for reducing the pressure of the gas in the fluid reservoir communicating with the gas in the fluid reservoir;

a level sensing device on the fluid reservoir for sensing the level of the liquid in the fluid reservoir and generating a signal based on the level of liquid, wherein the fluid level controller operates the gas supply valve and the vent valve in response to the signal based on the level of the liquid to control the pressure of the gas inside the fluid reservoir, thereby transferring produced fluids between the fluid reservoir and the pipeline system.

6. The apparatus as defined in claim 3 including a conduit inside the fluid reservoir communicating with the pump, wherein the pump and conduit are adapted to remove fluid from the inside of the fluid reservoir.

7. The apparatus as defined in claim 6 wherein the pump is inside the fluid reservoir.

8. The apparatus as defined in claim 7 wherein the pump is at least partially submerged in the fluids in the fluid reservoir when the pipeline system is shut down.

9. The apparatus of claim 6 further comprising a flowline for injecting hydrate inhibitor into the fluid in the fluid level control reservoir to prevent hydrate formation when fluids are pumped from the fluid reservoir.

10. The apparatus of claim 9 wherein the hydrate inhibitor is a chemical and is injected into the fluid reservoir adjacent the pump at the point at which the fluids in the fluid reservoir enter the pump.

11. An apparatus to prevent hydrate formation during start-up of a shut down pipeline system for transporting produced fluids having at least one riser, said pipeline system containing a quantity of fluid cooled to a temperature within the hydrate formation range at the operating pressure of the pipeline system and including a source of a second fluid in which hydrates will not form during start-up, said apparatus comprising:

a fluid reservoir in fluid communication with the pipeline system;

a pump for removing fluids from the fluid reservoir at a rate approximately equal to the rate that warm produced fluids are allowed to flow through the pipeline system during startup, whereby said pump maintains the fluid levels in the pipeline system and the fluid reservoir below the levels where the hydrostatic pressures resulting from such levels is outside the pressure range where hydrates may form.

12. The apparatus as defined in claim 11 wherein the fluid reservoir is placed in fluid communication with the pipeline system at a location sufficiently near the riser such that hydrates will not form in the fluids remaining in the pipeline system from the fluid reservoir to the riser when such fluids are removed as a column of fluid from the riser during start-up.

13. The apparatus defined on claim 12 wherein the length of the column is not greater than about 91 to 122 meters.

14. The apparatus of claim 12 further comprising:

a gas supply in fluid communication with the fluid reservoir;

a gas supply valve adapted to control flow between the gas supply and the fluid reservoir;

a vent valve in fluid communication with the fluid reservoir adapted to vent the fluid reservoir to atmospheric pressure;

a level sensing and signaling device which detects the level of liquids in the fluid reservoir and produces a signal indicative of such level; and a fluid level controller which responds to the signal from the level sensing and signaling device to close the vent valve and open the gas valve to empty the fluid reservoir of liquid after the pipeline system has warmed to a temperature greater than the temperature where hydrates may form at the operating pressure in the pipeline system, wherein said fluid level controller opens the gas supply valve to allow gas from the gas supply to enter the fluid reservoir and ihcrease the pressure to a level greater than the pressure of the fluid in the pipeline system to force liquid from the fluid level control reservoir, and thereafter said fluid level controller opens the vent valve until the pressure on the gas approximately equals the pressure on the fluid in the pipeline system so the liquid stays at approximately the same level in the fluid reservoir.

15. The apparatus as defined in claim 11 wherein the fluid level control reservoir is of sufficient cross sectional area to allow the liquid in the fluid level control reservoir to be degassed during shut down of the pipeline system and before being removed, so as to prevent hydrate formation therein during startup.

16. The apparatus of claim 11 further comprised of a flowline having a first end attached to a source of hydrate inhibitor and having a second end inside the fluid reservoir, said line being adapted for injecting and transporting hydrate inhibitor into the fluid reservoir to prevent hydrate formation in the fluids being removed from the fluid reservoir.

17. Apparatus to prevent hydrate formation in a pipeline system for transporting warm produced fluids from a source thereof when the pipeline system is shut down and during start up, the pipeline system including at least one riser initially containing a column of produced fluids when the pipeline system is shut down and a shut off valve for controlling the flow of produced fluids from the source and through the pipeline system, comprising:

a fluid reservoir in fluid communication with the pipeline system for receiving produced fluids from the pipeline system when the shut off valve is closed and the pipeline system is shut down;

a fluid level controller adapted to transfer produced fluids form the pipeline system to the fluid reservoir when the pipeline system is shut down in an amount sufficient to reduce the height of the column of produced fluids in the riser, and the hydrostatic pressure in the pipeline system resulting therefrom, an amount sufficient to prevent hydrate formation in the produced fluids in the shut down pipeline system;

a conduit having a first end inside the fluid reservoir and a second end extending outside of the fluid reservoir for removing fluids from the fluid reservoir;

a pump having an inlet and an outlet in fluid communication with the conduit and adapted for removing produced fluids from the fluid reservoir when the shut off valve is opened during start up of the pipeline system in amounts sufficient to prevent hydrate formation in the fluid reservoir and the pipeline system.

18. The apparatus as set forth in claim 17, including a pipe connected to the pipeline system and the fluid reservoir for establishing the fluid communication therebetween, wherein the pipe is connected to the pipeline system at a point sufficiently near the riser that hydrates will not form in the fluids in the pipeline system between such point and the riser when operation of the pipeline system is resumed.

19. The apparatus as set forth in claim 18 including a flow control valve in the conduit for controlling the rate at which produced fluids are removed from the fluid reservoir, wherein the pump is adapted to remove produced fluids form the fluid reservoir during start-up at substantially the same rate as the shut off valve permits produced fluids to flow through the pipeline system during such start-up.

20. The apparatus as set forth in claim 18 including a vent valve connected to the riser for venting the interior of the riser to atmospheric pressure when the pipeline system is shut down.

21. The apparatus as set forth in claim 19 wherein the pump is inside the fluid reservoir and is connected to the end of the conduit inside the fluid reservoir.

22. The apparatus as set forth in claim 18 wherein the fluid level controller comprises:

a pressurized gas supply communicating with the fluid reservoir;

a gas supply valve connected to the pressurized gas supply for controlling flow of the pressurized gas into the fluid reservoir;

a vent valve for reducing the pressure of the gas in the fluid reservoir communicating with the gas in the fluid reservoir;

a level sensing device on the fluid reservoir for sensing the level of the liquid in the fluid reservoir and generating a signal based on the level of liquid, wherein the fluid level controller operates the gas supply valve and the vent valve in response to the signal based on the level of the fluid to control the pressure of the gas inside the fluid reservoir, thereby transferring produced fluids between the fluid reservoir and the pipeline system.

23. The apparatus as set forth in claim 22 further comprising a flowline for injecting hydrate inhibitor into the fluid in the fluid level control reservoir to prevent hydrate formation when fluids are pumped from the fluid reservoir.

24. The apparatus as set forth in claim 23 wherein the hydrate inhibitor is a chemical and is injected into the fluid reservoir adjacent the pump at the point at which the fluids in the fluid reservoir enter the pump.

25. The apparatus as set forth in claim 18 wherein:

the pipeline system includes a first riser extending from the source of the produced fluids to a point adjacent the sea floor for receiving produced fluids from the source thereof and a second riser extending upwardly from the sea floor; and the pipe connecting the fluid reservoir to the pipeline system is connected to the pipeline system adjacent the second riser.

26. The apparatus as set forth in claim 25 including flow control valve in the conduit for controlling the rate at which produced fluids are removed from the fluid reservoir, wherein the pump is adapted to remove produced fluids form the fluid reservoir during start up at substantially the same rate as the shut off valve permits produced fluids to flow through the pipeline system during such startup.

27. The apparatus as set forth in claim 25 including a first vent valve connected to the first riser and a second vent valve connected to the second riser, wherein the first and second vent valves are adapted to vent the interior of the first and second risers, respectively, to atmospheric pressure.

28. The apparatus as set forth in claim 26 wherein the pump is inside the fluid reservoir and is connected to the end of the conduit inside the fluid reservoir.

29. A method for preventing hydrate formation in a pipeline system for transporting produced fluids from a source thereof, the pipeline system including at least one riser, comprising the steps of:

shutting down flow through the pipeline system;

removing produced fluids from the pipeline system in an amount sufficient to reduce the level of liquid produced fluids in the riser below the level at which hydrates will form in the produced fluids following shutdown of the pipeline system.

30. The method of claim 29 including the step of transferring the removed fluids into a fluid reservoir communicating with the pipeline system.

31. The method of claim 30 including the step of removing produced fluids form the fluid reservoir while such fluids are being transferred into the fluid reservoir from the pipeline system.

32. The method of claim 30 wherein the step of transferring the removed fluids into the fluid reservoir comprises the steps of:

maintaining a body of pressurized gas at an initial pressure about equal to the pipeline system operating pressure;

reducing the pressure of the pressurized gas in the fluid reservoir to a valve that is less than the pressure in the pipeline system after it is shut down, whereby liquids from the pipeline system flow into the fluid reservoir.

33. The method of claim 32 wherein the step of reducing the pressure in the fluid reservoir comprises venting the interior of the fluid reservoir to atmospheric pressure.

34. The method of claim 31 wherein the produced fluids are removed from the fluid reservoir by adding a pump and further comprising the step of adding a hydrate inhibitor to the produced fluids in the reservoir in amounts sufficient to prevent hydrate formation as the pump removes produced fluids.

35. A method for prevention of hydrate formation in a pipeline system for transporting warm produced fluids, said pipeline system including at least one riser and having a fluid reservoir in communication with the pipeline system and containing a pressurized gas, said method comprising the steps of:

shutting off the flow of fluids in the pipeline system thereby placing a fixed amount of fluid in the pipeline system;

venting the pressurized gas in the fluid reservoir to reduce the pressure in the fluid reservoir to allow the produced fluids in the pipeline system to enter the fluid reservoir until the liquid levels in the pipeline system and the fluid reservoir settle to approximately the same level, wherein said level is a preselected level that is less than the level at which the corresponding hydrostatic head will cause hydrates to form in the pipeline system at the temperature of the produced fluids while the pipeline system is shut in.

36. The method of claim 35 including the steps of removing produced fluids from the fluid reservoir in amounts sufficient to prevent hydrate formation in the pipeline system as a result of the hydrostatic head resulting from the level of liquids in the pipeline system.

37. The method for prevention of hydrates as defined in claim 35 wherein a pump is located within the fluid reservoir and wherein the step of removing produced fluids from the fluid reservoir comprises:

injecting a hydrate inhibitor into the fluid reservoir; and pumping fluid from the fluid reservoir, until the hydrostatic pressure in the pipeline system is less than the pressure where hydrates may form.

38. The method of claim 35 wherein the formation of hydrates is inhibited during the start-up of fluid flow through the system, further comprising the steps of:

flowing a fluid in which hydrates will not form at the conditions encountered during start up through the pipeline system; and removing fluids from the fluid reservoir at about the same rate as such fluids that will not form hydrates are flowing into the pipeline system, thereby keeping the hydrostatic pressure in the pipeline system below the pressure where hydrates may form while circulating fluids admitted into the pipeline system between the source and the fluid level control reservoir.

39. The method of claim 38 wherein the step of removing fluids from the fluid reservoir further comprises the step of pumping such fluid from the fluid reservoir using a pump in the fluid reservoir.

40. The method of claim 39 wherein the fluids that will not form hydrates are warm produced fluids.

41. The method of claim 39 wherein the fluids that will not form hydrates are fluids that have been treated to prevent hydrate formation therein during start-up.

42. The method of claim 39 further comprised of the step of placing a hydrate inhibitor into the fluid level control reservoir to prevent hydrate formation in the flowline attached to the pump.

43. The method of claim 39 further comprising the steps of:

admitting a pressurized gas into the fluid reservoir to increase the pressure on the fluids in the fluid reservoir so as to displaced liquid from the fluid reservoir; and reducing the pressure on the gas in the fluid reservoir when the liquids have been displaced from the fluid reservoir to a pressure substantially equal to the pressure on the fluids in the pipeline system, whereby liquids do not enter the fluid reservoir and the gas in the fluid reservoir does not enter the pipeline system in a substantial amount.

* * * * *